US009395163B2

(12) United States Patent
Fritz

(10) Patent No.: US 9,395,163 B2
(45) Date of Patent: Jul. 19, 2016

(54) HOLLOW SLUG AND CASING

(71) Applicant: Randy R. Fritz, Bloomsburg, PA (US)

(72) Inventor: Randy R. Fritz, Bloomsburg, PA (US)

( * ) Notice: Subject to any disclaimer, the term of this patent is extended or adjusted under 35 U.S.C. 154(b) by 0 days.

(21) Appl. No.: 14/593,478

(22) Filed: Jan. 9, 2015

(65) Prior Publication Data

US 2015/0192394 A1 Jul. 9, 2015

Related U.S. Application Data

(60) Provisional application No. 61/925,539, filed on Jan. 9, 2014.

(51) Int. Cl.

| | |
|---|---|
| ***F42B 5/067*** | (2006.01) |
| ***F42B 10/22*** | (2006.01) |
| ***F42B 5/02*** | (2006.01) |
| ***F42B 7/10*** | (2006.01) |
| *F42B 14/02* | (2006.01) |

(52) U.S. Cl.

CPC . *F42B 5/025* (2013.01); *F42B 7/10* (2013.01); *F42B 14/02* (2013.01)

(58) Field of Classification Search

CPC ..... F42B 5/00; F42B 5/02; F42B 5/26; F42B 5/28; F42B 5/067; F42B 5/073; F42B 3/24; F42B 12/34; F42B 12/367; F42B 10/22; F42B 33/005; F42B 30/02

USPC ..... 102/430, 439, 462, 501, 507, 508, 509, 102/524

See application file for complete search history.

(56) References Cited

U.S. PATENT DOCUMENTS

| | | | | | |
|---|---|---|---|---|---|
| 1,108,717 | A | * | 8/1914 | Davis | F42B 5/02 102/430 |
| 1,187,867 | A | * | 6/1916 | Shinkle | 102/501 |
| 1,470,591 | A | * | 10/1923 | Behar | 102/430 |
| 2,083,665 | A | * | 6/1937 | Pihl et al. | 102/431 |
| 2,568,080 | A | * | 9/1951 | McGahey, Jr. | 102/430 |
| 2,862,446 | A | * | 12/1958 | Ringdal | 102/430 |
| 3,099,958 | A | * | 8/1963 | Daubenspeck et al. | 102/449 |
| 3,349,711 | A | * | 10/1967 | Darigo et al. | 102/509 |
| 3,477,375 | A | * | 11/1969 | Barr | F42B 5/02 102/470 |
| 3,566,792 | A | * | 3/1971 | Grandy | 102/430 |
| 3,749,020 | A | * | 7/1973 | Weyhmuller | F42B 5/073 102/430 |
| 3,842,739 | A | * | 10/1974 | Scanlon et al. | 102/467 |
| 3,913,487 | A | * | 10/1975 | Scherr | 102/501 |
| 4,024,819 | A | * | 5/1977 | Schirneker | F41A 5/20 102/430 |
| 4,517,897 | A | * | 5/1985 | Kneubuhl | 102/439 |
| 4,939,996 | A | * | 7/1990 | Dinkha et al. | 102/501 |
| 4,955,938 | A | * | 9/1990 | Romer et al. | 102/430 |
| 5,080,018 | A | * | 1/1992 | Reuter | 102/439 |
| 5,259,288 | A | * | 11/1993 | Vatsvog | 86/10 |

(Continued)

*Primary Examiner* — Bret Hayes
*Assistant Examiner* — Derrick Morgan
(74) *Attorney, Agent, or Firm* — The Webb Law Firm

(57) ABSTRACT

An ammunition round includes a slug having a cylindrical body portion and a slug casing having a cylindrical body with an open top end, a closed bottom end, and an interior cavity extending therebetween. The interior cavity is configured for receiving at least a portion of the cylindrical body portion of the slug. At least one groove extends circumferentially around at least a portion of one of the cylindrical body portion of the slug and the interior cavity of the slug casing. At least one projection extends circumferentially around at least a portion of the other of the cylindrical body portion of the slug and the interior cavity of the slug casing. The at least one projection is configured for being received within at least a portion of the at least one groove.

17 Claims, 8 Drawing Sheets

(56) References Cited

U.S. PATENT DOCUMENTS 5,259,319 A * 11/1993 Dravecky et al. ..... 102/447
5,708,231 A * 1/1998 Koon ..... 102/439
6,679,178 B2 * 1/2004 Mihaylov et al. ..... 102/439
7,219,607 B2 * 5/2007 Oertwig ..... 102/501
7,549,376 B1 * 6/2009 Grossman et al. ..... 102/473
7,610,858 B2 * 11/2009 Chung ..... 102/466
7,819,065 B2 * 10/2010 Haeselich ..... 102/444
8,573,126 B2 * 11/2013 Klein et al. ..... 102/467
2003/0167952 A1 * 9/2003 Heidenreich et al. ..... 102/431
2003/0167954 A1 * 9/2003 Baumgartner et al. ..... 102/510
2005/0005806 A1 * 1/2005 Mace ..... F42B 5/02 102/430
2005/0081704 A1 * 4/2005 Husseini ..... 86/55
2005/0223882 A1 * 10/2005 Yaich ..... 86/54
2007/0204758 A1 * 9/2007 Spatz et al. ..... 102/514
2007/0261587 A1 * 11/2007 Chung ..... F42B 5/313 102/469
2009/0145323 A1 * 6/2009 Gustavsson et al. ..... 102/524
2010/0229750 A1 * 9/2010 Mutascio ..... F42B 5/18 102/431
2010/0307367 A1 * 12/2010 Minick et al. ..... 102/517
2011/0079164 A1 * 4/2011 Broden ..... F42B 8/14 102/444
2011/0107937 A1 * 5/2011 Thompson ..... F42B 12/74 102/517
2012/0111219 A1 * 5/2012 Burrow ..... 102/467
2012/0180688 A1 * 7/2012 Padgett ..... 102/466
2013/0014664 A1 * 1/2013 Padgett ..... 102/439
2013/0186294 A1 * 7/2013 Davies ..... F42B 5/307 102/467
2015/0226531 A1 * 8/2015 Silvers ..... F42B 5/28 102/439
2016/0025471 A1 * 1/2016 Nixon ..... B22C 9/06 86/18

* cited by examiner

HOLLOW SLUG AND CASING

CROSS-REFERENCE TO RELATED APPLICATIONS

The present application claims priority to U.S. Provisional Application No. 61/925,539, entitled "Hollow Slug and Casing" and filed on Jan. 9, 2014, the disclosure of which is incorporated herein by reference in its entirety.

BACKGROUND OF THE INVENTION

1. Field of the Invention

The present invention relates, in general, to an ammunition round for use with rifled or non-rifled barrels, and, more particularly, to a hollow slug having a circumferential recess configured to engage a projection on a slug casing.

2. Description of the Related Art

Regardless of whether used in hunting, military, or law enforcement applications, a slug is a type of an ammunition round typically used with a shotgun. The slug is a heavy projectile, typically made from lead, copper-covered lead, or other metal, encased in a plastic or metal casing. The slug projectile and its propellant are encased in a single casing. The external dimension of a slug casing and/or the slug projectile is dimensioned such that the outer dimension of the slug casing and/or the slug projectile is nominally the same as the internal diameter of the rifle or gun barrel. This is an important design consideration in order to create a tight seal between the slug and the barrel for preventing the escape of gas generated by the propellant once the gun is fired. Most conventional slugs are specifically designed for use with either rifled or non-rifled barrels. Slugs for use in rifled barrels usually have a solid core, while slugs for use with non-rifled barrels may have a solid or hollow core.

Certain slug designs utilized with rifled barrels may have a hollow projectile that has a pit or hollowed-out shape at its tip. Generally, these types of slugs are intended to cause the slug to fragment upon impact, such that most of the kinetic energy of the slug is expended upon impact. When a slug of this kind strikes a target, the slug widens at its tip to increase the frontal surface area of the slug and limit its depth of penetration. Other collapsible slug designs have cutout portions which collapse and expand once the slug strikes a target. These slugs feature openings that have portions of the core extruded out and have a tip portion that is prevented from rotational or longitudinal movement until the inner part of the tip near the extruded portions is weakened upon impact to allow for a "mushrooming" effect.

In general, most slugs are encased inside a plastic casing that is filled with a propellant, such as gun powder. The casing is typically a thin-walled cylindrical structure with an open top end and a closed bottom end. The propellant is ignited by a primer housed at the base of the casing that is acted upon by a firing pin. One or more additional materials, such as a gas seal, sabot, concertina pressure wad, or spacer wad, are packed between the propellant and the slug. Typically, this additional material takes up volume within the casing, seals the bore, and reduces the friction between the slug and the barrel as the slug travels through the barrel upon firing. The slug is firmly retained within the casing until the propellant is ignited. The buildup of pressure inside the casing causes the slug to be released and fired from the barrel.

Regardless of whether the firing weapon has a rifled or non-rifled barrel, an important design consideration in making slugs is ensuring that the slug casing opens up to release the slug during firing. Cold weather, in particular, exacerbates the problem. In very cold temperatures, the common practice of using a Star Crimp or a Roll Crimp to hold slugs in place often causes the top end of the casing to split or become separated from the cylindrical sidewall causing erratic performance and accuracy.

It will readily be appreciated by those skilled in the art that the problems associated with existing slug designs call for a solution that is not readily available within the prior art.

SUMMARY OF THE INVENTION

In view of the foregoing, a need exists for an ammunition round having a hollow slug structure with a circumferential recess that eliminates the problems commonly associated with prior hollow slug designs. An additional need exists for providing an ammunition round that is easy and cost-efficient to manufacture and achieves superior firing characteristics compared to conventional designs.

In accordance with one embodiment, an ammunition round may include a slug having a cylindrical body portion and a slug casing having a cylindrical body with an open top end, a closed bottom end, and an interior cavity extending therebetween. The interior cavity may be configured for receiving at least a portion of the cylindrical body portion of the slug. At least one groove may extend circumferentially around at least a portion of one of the cylindrical body portion of the slug and the interior cavity of the slug casing. At least one projection may extend circumferentially around at least a portion of the other of the cylindrical body portion of the slug and the interior cavity of the slug casing. The at least one projection may be configured for being received within at least a portion of the at least one groove.

In another embodiment, the ammunition round may include a slug that has a conical tip monolithically formed with the body portion. At least one of the body portion and the conical tip may define a hollow internal cavity. The at least one groove may protrude radially inward from an outer sidewall of the cylindrical body portion of the slug, and the at least one projection may protrude radially inward from the interior cavity. At least one band may be recessed radially inward from an outer sidewall of the cylindrical body portion of the slug. The at least one band may extend circumferentially around at least a portion of the outer sidewall of the cylindrical body portion of the slug. The at least one groove may protrude radially inward into the at least one band.

In another embodiment, the ammunition round may include a slug casing that has a slug cavity at the open top end for receiving the slug within the slug cavity. The slug cavity may have a seat for engaging a terminal end of the slug when the slug is inserted into the slug cavity. The at least one projection may protrude radially inward from an inner sidewall of the slug cavity. The at least one projection may extend circumferentially around at least a portion of the inner sidewall of the slug cavity. An inner diameter of the at least one projection may be smaller than an outer diameter of the at least one groove such that an interference fit is formed between the slug and the slug casing. The at least one projection may have a rounded shape, and the at least one groove may have a corresponding rounded shape configured to receive at least a portion of the at least one projection. The at least one projection may extend continuously or discontinuously around an inner circumference of the interior cavity of the slug casing. At least a portion of the interior cavity of the slug casing may define a propellant cavity. A propellant may be received in the propellant cavity. A bottom portion of the propellant cavity may have a radially inwardly tapering portion. The propellant cavity may have an increased sidewall thickness relative to a sidewall thickness of the slug casing.

In another embodiment, a slug casing may have a cylindrical body having an open top end, a closed bottom end, and an interior cavity extending therebetween. A slug casing may further have a slug cavity having a slug seat configured for receiving at least a portion of a slug. The slug casing may further have a propellant cavity configured for receiving a propellant, and at least one projection protruding radially inward from an inner sidewall of the slug cavity. The at least one projection may extend circumferentially around at least a portion of the slug cavity and may be configured for being received within a corresponding groove on the slug.

In another embodiment, an ammunition round for use with a weapon having a barrel may include a slug casing and a slug. The slug casing may include a cylindrical body with an open top end, a closed bottom end, and an interior cavity extending therebetween. The slug casing may further include a slug cavity having a slug seat, a propellant cavity configured for receiving a propellant, and at least one projection protruding radially inward from an inner sidewall of the slug cavity and extending circumferentially around at least a portion of the slug cavity. The slug may be received in at least a portion of the slug cavity of the slug casing. The slug may have a cylindrical body portion and a conical tip monolithically formed with the body portion. At least one of the body portion and the conical tip may define a hollow internal cavity. At least one groove may protrude radially inward from an outer sidewall of the cylindrical body portion of the slug. The at least one projection may be configured for being received within at least a portion of the at least one groove.

These and other features and characteristics of the ammunition round, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only. As used in the specification and the claims, the singular form of "a", "an", and "the" include plural referents unless the context clearly dictates otherwise.

DETAILED DESCRIPTION OF THE INVENTION

Figure 1A:
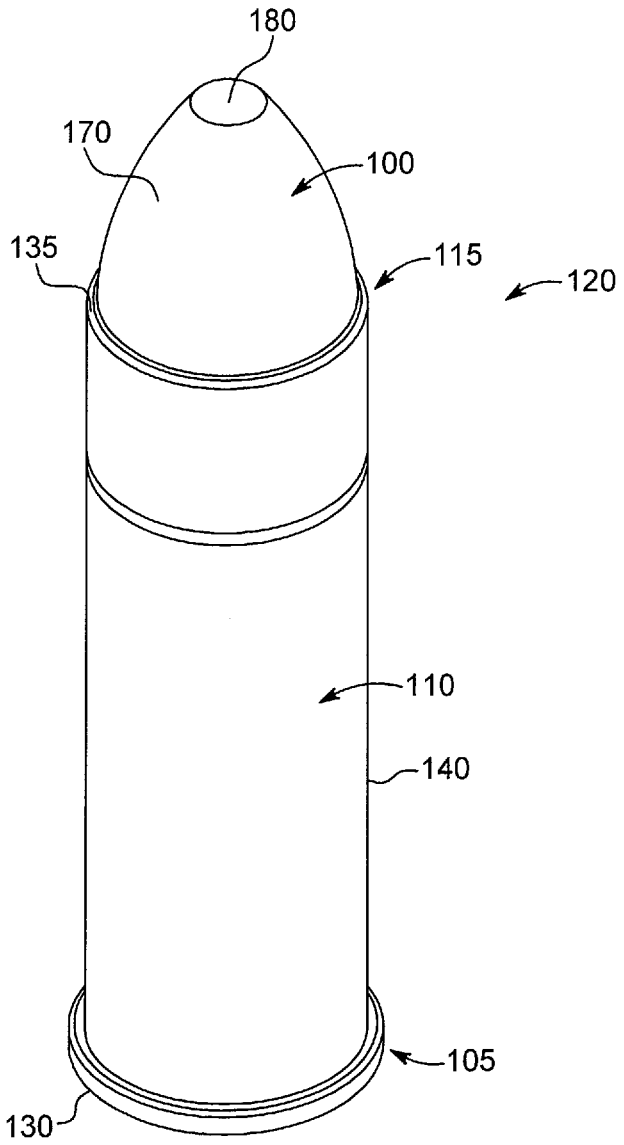
FIG. 1A shows a top perspective view of an ammunition round in accordance with one embodiment.

For purposes of the description hereinafter, the terms "upper", "lower", "right", "left", "vertical", "horizontal", "top", "bottom", "lateral", "longitudinal", and derivatives thereof shall relate to the disclosure as it is oriented in the drawing figures. When used in relation to an ammunition round, the term "distal" refers to a portion of an ammunition round oriented in a firing direction of an ammunition round, while the term "proximal" refers to a portion of an ammunition round oriented opposite to the firing direction of an ammunition round. It is also to be understood that the specific elements and processes illustrated in the attached drawings, and described in the following specification, are simply exemplary embodiments of the disclosure. Hence, specific dimensions and other physical characteristics related to the embodiments disclosed herein are not to be considered as limiting.

Referring to the drawings in which like reference characters refer to like parts throughout the several views thereof, the present disclosure is generally directed to one or more embodiments of an ammunition round for use in weapons having rifled or non-rifled barrels, such as shotguns. The ammunition round includes multiple components as individually described herein. Generally, the ammunition round is configured for being loaded into and fired from a weapon having a rifled or a non-rifled barrel, as described herein.

Figure 1B:
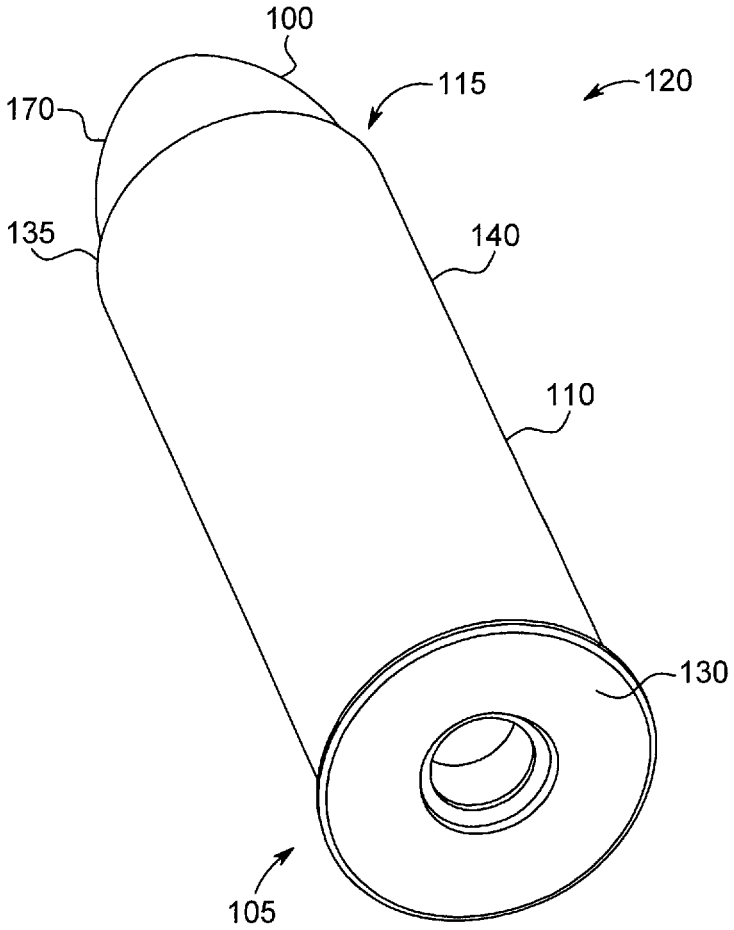
FIG. 1B shows a bottom perspective view of the ammunition round shown in FIG. 1A.
Figure 1C:
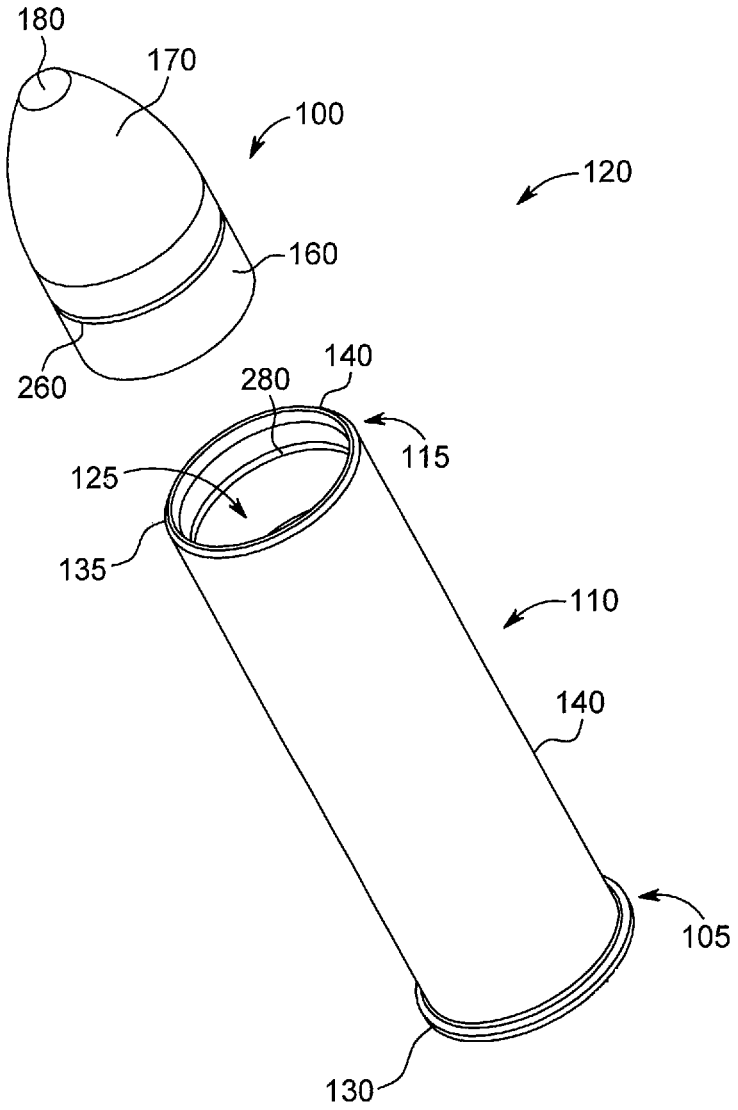
FIG. 1C shows an exploded perspective view of the ammunition round shown in FIG. 1A.

With reference to FIGS. 1A-1C, an ammunition round 120 is illustrated in accordance with one embodiment. The ammunition round 120 is configured for being loaded into and fired from a weapon, such as a shotgun. In various embodiments, the ammunition round 120 may be configured for use with weapons having rifled or non-rifled barrels. For example, the ammunition round 120 may be sized in accordance with sizing requirements proposed by the Sporting Arms and Ammunition Manufacturers' Institute. In some embodiments, the ammunition round 120 may be a 32-10 gauge round. Furthermore, the ammunition round 120 may be configured for use with manually, semi-automatically, or automatically reloading weapons. In accordance with one embodiment, the ammunition round 120 has a slug 100 and a corresponding casing 110. The slug 100 and the casing 110 together constitute the ammunition round 120. The casing 110 has a generally cylindrical form with the slug 100 being disposed on the open top portion at a distal end 115 of the casing 110 such that the casing 110 encloses part of the slug 100 to form the ammunition round 120. The slug 100 may be completely or partially recessed within the distal end 115 of the casing 110. The proximal end, 105 of the casing 110 is configured for engagement with a firing pin of a weapon, as described herein. An interior portion 125 of the casing 110 (shown in FIG. 1C) is configured for being filled with a propellant, such as gun powder, to propel the slug 100 from the casing 110 upon firing of the ammunition round 120.

Figure 2:
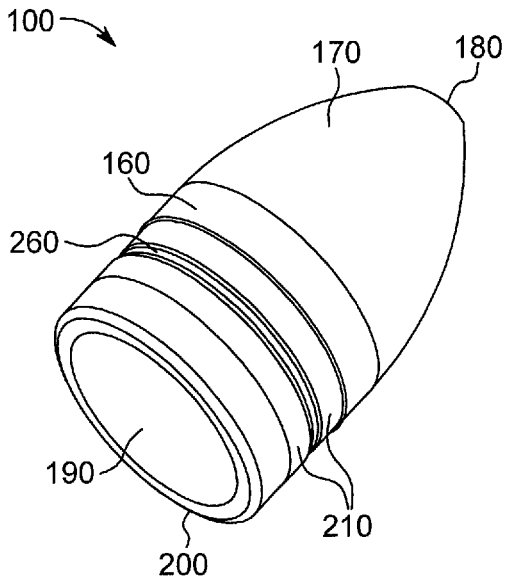
FIG. 2 is a perspective view of a slug of the ammunition round shown in FIG. 1A.
Figure 3:
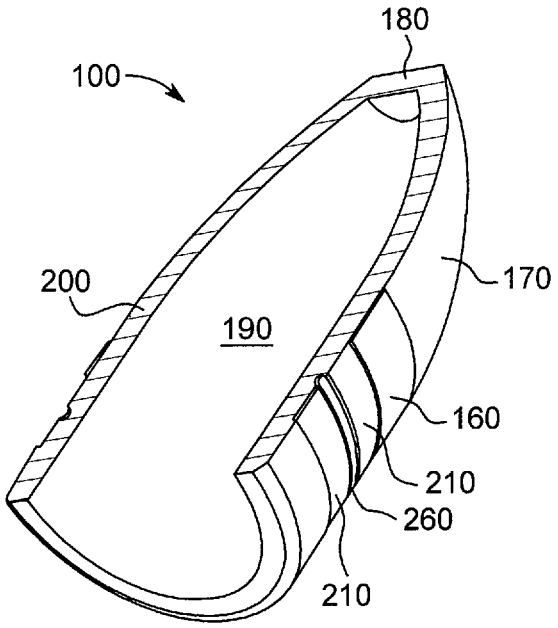
FIG. 3 is a cross-sectional view of the slug shown in FIG. 2.

With reference to FIGS. 2-3, the slug 100 is shown without the corresponding casing 110. The slug 100 may be manufactured from a metallic or plastic material of sufficient material strength to withstand being fired through the barrel of a weapon. Various manufacturing techniques may be utilized to manufacture the slug 100. For example, in some embodiments, the slug 100 may be machined from a solid block of material. In other embodiments, the slug 100 may be manufactured using a 3D printing technique by laying successive layers of material. In further embodiments, the slug 100 may be cast, forged, die-formed, or made using any other manufacturing process.

With continuing reference to FIGS. 2-3, the slug 100 has a cylindrical body portion 160 and a conical tip 170 monolithically formed with the body portion 160. The conical tip 170 may have a blunt terminal surface 180. In some embodiments, the conical tip 170 may terminate at a point (not shown). The interior of the body portion 160 and conical tip 170 is hollowed out to form an internal cavity 190. In some embodiments, the interior of the body portion 160 and/or the conical tip 170 may be solid. A sidewall 200 having a substantially uniform thickness defines the structure of the body portion 160 and conical tip 170. In another embodiment, the sidewall 200 may be non-uniform, such that the thickness of the sidewall 200 varies from a distal end to a proximal end of the slug 100. For example, the sidewall 200 may be thicker at the conical tip 170 than at the body portion 160, or vice versa.

In some embodiments, at least one recessed band 210 is provided on the body portion 160 and extends circumferentially into the sidewall 200 on the outer side of the slug 100. The recessed band 210 desirably reduces the surface area of contact between the body portion 160 and the gun barrel to reduce the friction between the body portion 160 and the gun barrel as the slug 100 travels through the barrel upon firing. In embodiments where the outer diameter of the slug 100 is substantially smaller than the inner diameter of the barrel, the slug 100 may be used with a sabot (not shown).

With continuing reference to FIGS. 2-3, the slug 100 includes a groove 260 extending circumferentially around at least a portion of the outer circumference of the body portion 160. The groove 260 extends radially inward from the exterior portion of the sidewall 200, such that a thinner sidewall profile is created at the location of the groove 260. In the embodiment illustrated in FIGS. 2-3, the groove 260 is provided on the recessed band 210. In other embodiments, the groove 260 may be provided on any part of the body portion 160. One or more grooves 260 may be provided. The groove 260 is configured to engage a projection extending from the interior sidewall of the casing 110, as described herein.

Figure 4:
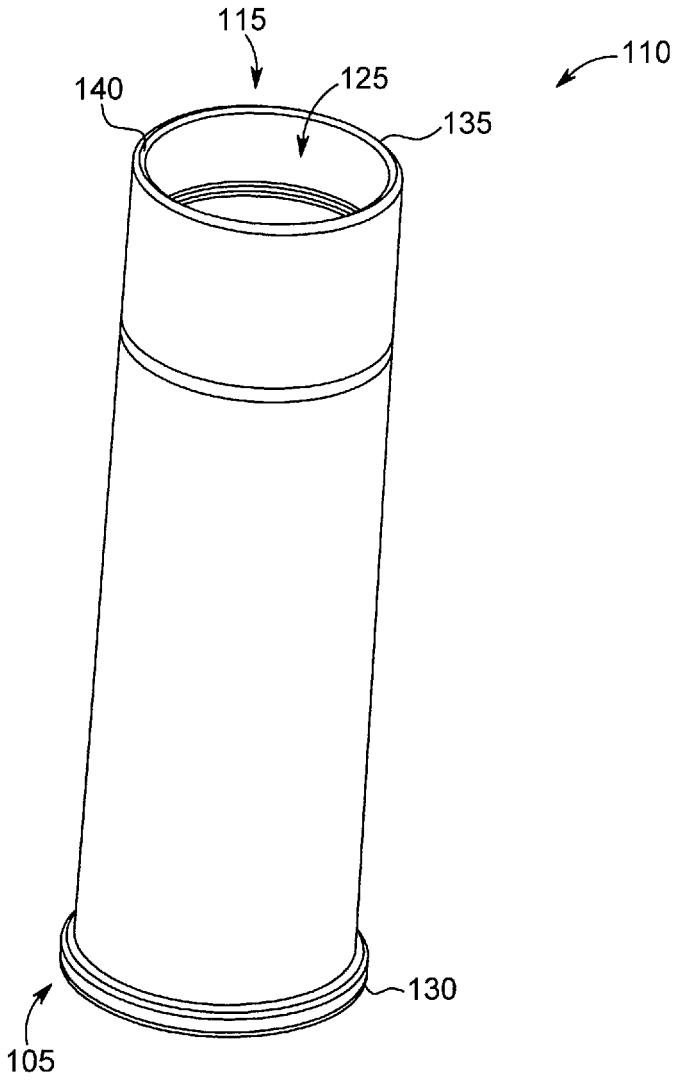
FIG. 4 is a perspective view of a casing of the ammunition round shown in FIG. 1A.
Figure 5:
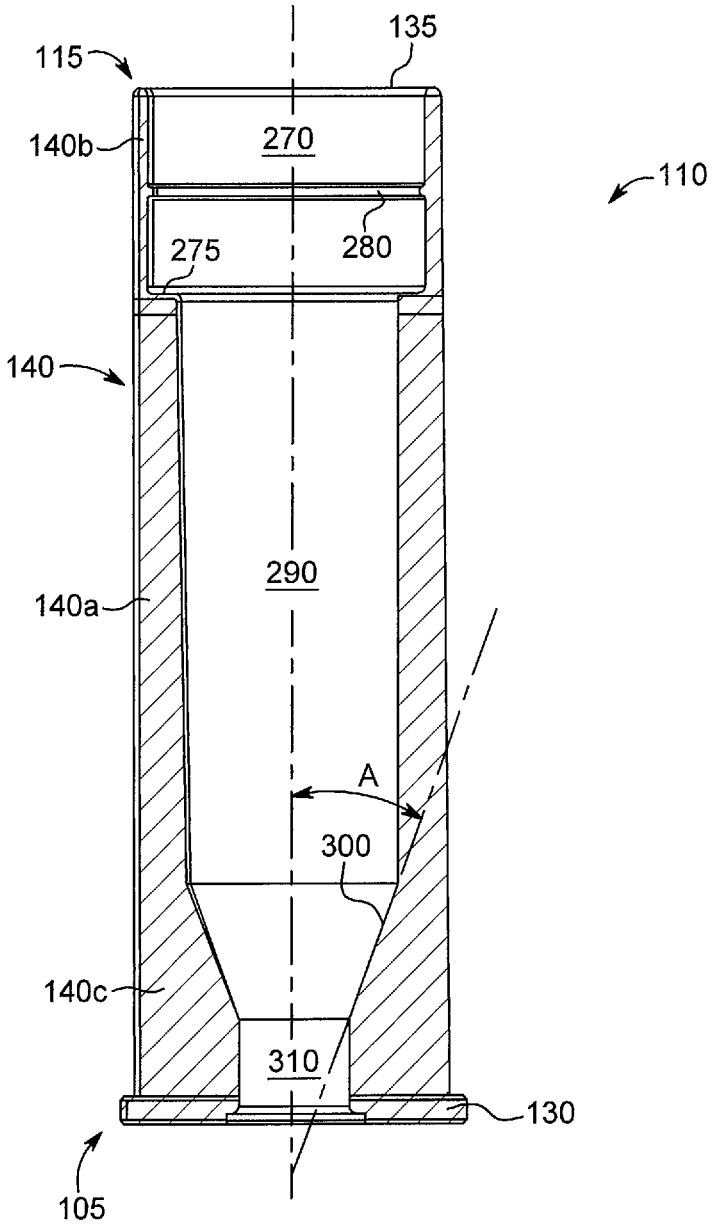
FIG. 5 is a cross-sectional view of the casing shown in FIG. 4.

With reference to FIGS. 4-5, the casing 110 has a generally cylindrical form, including a closed bottom portion 130, an open top portion 135, and a casing sidewall 140 extending circumferentially between the proximal end 105 and the distal end 115. A primer 150 (shown in FIG. 6) is located at the terminal end of the closed bottom portion 130 for interacting with a firing pin of a weapon (not shown). The interior of the casing 110 is filled with a propellant 145 in the form of a powder (shown in FIG. 6). The casing 110 may be manufactured from a metallic or plastic material of sufficient material strength to withstand the firing forces as the ammunition round 120 (shown in FIG. 1A) is fired. The casing 110 may be made in various lengths to accommodate various chambers. In some embodiments, the casing 110 may be 2-3.5 inches long. Various manufacturing techniques may be utilized to manufacture the casing 110. For example, in some embodiments, the casing 110 may be molded from a metallic or plastic material, including, but not limited to plastic, brass, and aluminum. In other embodiments, the casing 110 may be machined, 3D printed, cast, forged, die-formed, or made using any other manufacturing process.

Figure 6:
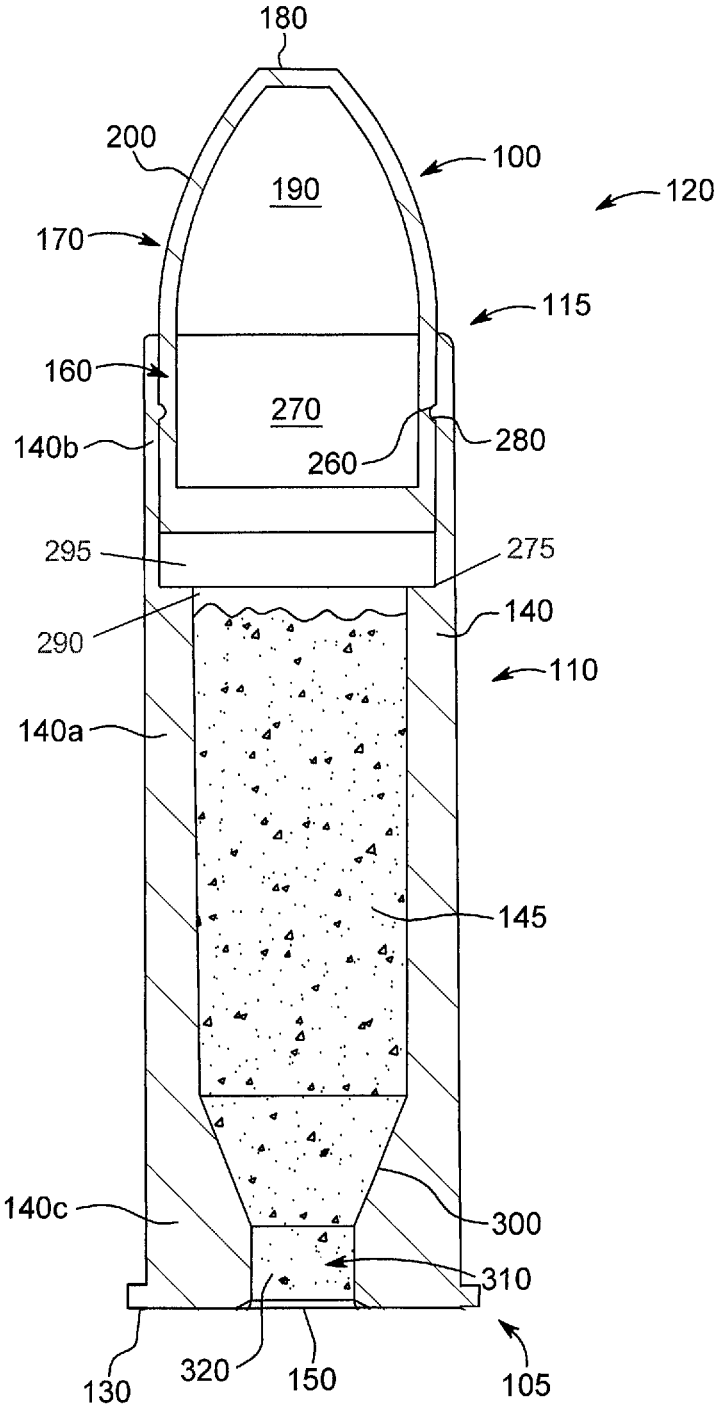
FIG. 6 is a side cross-sectional view of the ammunition round shown in FIG. 1A showing the internal structure thereof.

With reference to FIG. 5, the sidewall 140 of the casing 110 may have a non-uniform thickness between the top portion 135 and the bottom portion 130. Proximate to the top portion 135, the casing 110 defines a slug cavity 270 configured for receiving the slug 100. The slug cavity 270 includes a slug seat 275 for receiving the terminal end of the slug body 160. The slug seat 275 is configured for preventing the slug 100 from being displaced too far into the internal cavity of the casing 110 toward the proximal end 105 due to any pressure generated on the slug 100 during loading. In some embodiments, such as shown in FIG. 6, the slug seat 275 may support a chamber length compensator 295. The chamber length compensator 295 may be formed as a disc that engages the slug seat 275 at one end and supports the slug 100 at the other end. The chamber length compensator 295 may be made from plastic, cork, or any other pliable material. The chamber length compensator 295 may be provided to control a pressure buildup upon firing the ammunition round 120 until the slug 100 advances through a chamber-size bore section and seals the bore. In this manner, a shorter ammunition round 120 may be used in different length chambers without noticeable differences in firing of the ammunition round.

Figure 7:
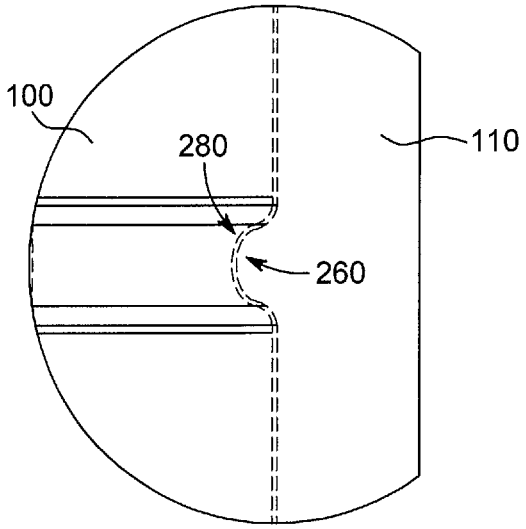
FIG. 7 is an enlarged view of a portion of the ammunition round shown in FIG. 6.

With reference to FIG. 5, the slug cavity 270 further includes at least one projection 280 that extends radially inward from the interior portion of the sidewall 140. The projection 280 may extend circumferentially around at least a portion of the inner circumference of the slug cavity 270. With reference to FIG. 7, the projection 280 is formed to correspond to the shape of the groove 260 on the slug 100. For example, the groove 260 may have a rounded shape that receives a similarly rounded projection 280. In other embodiments, the groove 260 and/or the projection 280 may have a linear, non-linear, continuous, or discontinuous shape. A plurality of grooves 260 may be provided to receive a corresponding plurality of projections 280. In some embodiments, at least a portion of the projection 280 is configured to fit within the groove 260 on the slug 100. In some embodiments, at least a portion of the groove 260 on the slug 100 receives at least a portion of the projection 280 on the casing 110. The projection 280 is received within the groove 260 when the slug 100 is inserted into the casing 110, as described herein. In some embodiments, the groove 260 and the projection 280 may be reversed, such that the projection 280 is provided on the slug 100, while the groove 260 is provided on the casing 110. Engagement of the projection 280 with the groove 260 stops the slug 100 from sliding toward the proximal end 105 (shown in FIG. 6) of the casing 110 due to, for example, recoil from the weapon as another ammunition round 120 is fired. In addition, engagement of the projection 280 with the groove 260 stops the slug 100 from being expelled from the casing 110 before a uniform firing pressure is developed within the interior of the casing 110. The amount of force necessary to unseat the slug 100 from the casing 110 by disengaging the projection 280 from the groove 260 may be controlled by changing the contact area between the projection 280 and the groove 260 and/or changing the shape of the projection 280 and/or the groove 260.

With continued reference to FIG. 5, the interior cavity of the casing 110 further defines a propellant cavity 290 located distally of the slug cavity 270. The propellant cavity 290 is configured to receive a quantity of propellant 145 sufficient to propel the slug 100 upon firing. The sidewall 140*a* of the propellant cavity 290 may be thicker than the sidewall 140*b* of the slug cavity 270. The increased thickness of the sidewall 140*a* of the propellant cavity 290 increases the structural strength of the casing 110 and prevents the casing 110 from bulging radially outward due the force of expanding gases within the interior of the casing 110. Moreover, the sidewall 140*a* of the propellant cavity 290 may be substantially thicker than the sidewall of conventional casings such that the volume of propellant 145 that can be received within the propellant cavity 290 is appreciably smaller. For example, in some embodiments, the total volume of the slug cavity 270 and the propellant cavity 290 may be around 50% of the volume of an interior cavity of a conventional slug casing. At least a portion of this reduction in volume may be accomplished by a reduction in the overall length of the casing 110 relative to the length of a conventional casing.

With continued reference to FIG. 5, a bottom portion of the propellant cavity 290 proximate to the bottom portion 130 of the casing 110 may include an inwardly tapering portion 300. The inwardly tapering portion 300 may be tapered at an angle A relative to a longitudinal axis extending between the proximal end 105 and the distal end 115 of the casing 110. In some embodiments, the inwardly tapering portion 300 may be tapered at an angle of 21 to 69 degrees, depending on the weight of the slug 100 and type of the propellant used. The angle of the inwardly tapering portion 300 may aid in the propagation of flame when the primer 150 is activated by a firing pin (not shown) to light the propellant 145. For example, in some embodiments, the inwardly tapering portion 300 may help in a gradual flashing of the propellant 145 to prevent premature detonation. In some embodiments, the reduction in the volume of the interior cavity may compensate for the volume that is made available by the lack of additional materials, such as gas seals, filler wads, or sabots that are found in conventional slug casings. Thus, the amount of propellant may be kept the same compared to conventional slug casings while decreasing the internal volume of the casing. This makes a stronger casing that is capable of withstanding the firing forces within the barrel without disintegrating.

With continued reference to FIG. 5, the casing 110 further includes a primer cavity 310 at a proximal end of the inwardly tapering portion 300. The primer cavity 310 may be configured to receive a quantity of a primer charge 320 (shown in FIG. 6) for igniting the propellant 145 (shown in FIG. 6) upon firing of the primer 150. The primer cavity 310 may have a sidewall 140*c* that is substantially thicker than the sidewall 140*a* of the propellant cavity 290 or the sidewall 140*b* of the slug cavity 270 to prevent the sidewall 140*c* from rupturing during firing.

With reference to FIGS. 6-7, the slug 100 is manufactured to have an external diameter that is slightly larger than the internal diameter of the slug cavity 270 of the casing 110. The difference in diameter between the slug 100 and the casing 110 creates an interference fit to ensure that the slug 100 is securely retained within the casing 110. The slug 100 is further retained within the casing 110 by the projection 280 that is received within the groove 260 once the slug 100 is fully inserted into the slug cavity 270 of the casing 110. In some embodiments, the outer diameter of the slug 100 may be 0.0035-0.0045 inches larger than an inner diameter of the casing 110. Once fitted, the slug 100 seals the casing 110. A gas seal or wad (not shown) may or may not be used in combination with the slug 100 to seal the casing 110.

While the ammunition round of the present invention has been described with respect to various preferred and non-limiting embodiments, various modifications and alterations may be made without departing from the spirit and scope of the present invention. The scope of the present invention is defined in the appended claims and equivalents thereto. The ammunition round can be used as a frangible configuration, where limited slug impact is required. For example, for use on ships and planes, where the fuselage cannot be pierced yet personnel must be impacted.

The invention claimed is:

1. An ammunition round comprising:

a slug having a cylindrical body portion;

at least one band recessed radially inward from an outer sidewall of the cylindrical body portion of the slug, the at least one band extending circumferentially around at least a portion of the outer sidewall of the cylindrical body portion;

a slug casing having a cylindrical body with an open top end, a closed bottom end, and an interior cavity extending therebetween, the interior cavity configured for receiving at least a portion of the cylindrical body portion of the slug;

at least one groove extending circumferentially around at least a portion of the cylindrical body portion of the slug; and at least one projection extending circumferentially around at least a portion of the interior cavity of the slug casing below the open top end, wherein an external diameter of the cylindrical body portion of the slug is larger than an internal diameter of the interior cavity of the slug casing such that the slug is retained within the interior cavity by an interference fit, wherein the at least one projection is configured for being received within at least a portion of the at least one groove, and wherein the at least one groove is provided on the recessed band, and wherein a slug cavity has a seat proximate a terminal end of the slug when the slug is inserted into the slug cavity.

2. The ammunition round of claim 1, wherein the slug further comprises a conical tip monolithically formed with the cylindrical body portion.

3. The ammunition round of claim 2, wherein at least one of the cylindrical body portion and the conical tip define a hollow internal cavity.

4. The ammunition round of claim 1, wherein the at least one groove protrudes radially inward from an outer sidewall of the cylindrical body portion of the slug and wherein the at least one projection protrudes radially inward from the interior cavity.

5. The ammunition round of claim 1, wherein the at least one groove protrudes radially inward into the at least one band.

6. The ammunition round of claim 1, wherein the slug casing further comprises the slug cavity at the open top end for receiving the slug within the slug cavity.

7. The ammunition round of claim 6, wherein the at least one projection protrudes radially inward from an inner sidewall of the slug cavity.

8. The ammunition round of claim 7, wherein the at least one projection extends circumferentially around at least a portion of the inner sidewall of the slug cavity.

9. The ammunition round of claim 1, wherein an inner diameter of the at least one projection is smaller than an outer diameter of the at least one groove such that an interference fit is formed between the slug and the slug casing.

10. The ammunition round of claim 1, where the at least one projection has a rounded shape and wherein the at least one groove has a corresponding rounded shape configured to receive at least a portion of the at least one projection.

11. The ammunition round of claim 1, wherein the at least one projection extends continuously or discontinuously around an inner circumference of the interior cavity of the slug casing.

12. The ammunition round of claim 1, wherein at least a portion of the interior cavity of the slug casing defines a propellant cavity.

13. The ammunition round of claim 12, wherein a propellant is received in the propellant cavity.

14. The ammunition round of claim 12, wherein a bottom portion of the propellant cavity has a radially inwardly tapering portion.

15. The ammunition round of claim 12, wherein the propellant cavity has an increased sidewall thickness relative to a sidewall thickness of the slug casing.

16. A slug casing comprising:

a cylindrical body having an open top end, a closed bottom end, and an interior cavity extending therebetween;

a slug cavity extending below the open top end, the slug cavity having an inner sidewall and a slug seat at a bottom of the sidewall configured for receiving at least a portion of a slug;

a propellant cavity configured for receiving a propellant; and at least one projection protruding radially inward from the inner sidewall of the slug cavity below the open top end, wherein the at least one projection extends circumferentially around at least a portion of the slug cavity, and wherein the at least one projection is configured for being received within a corresponding groove which protrudes radially inward into a recessed band on the slug.

17. An ammunition round for use with a weapon having a barrel, the ammunition round comprising:

a slug casing comprising:

a cylindrical body with an open top end, a closed bottom end, and an interior cavity extending therebetween;

a slug cavity extending below the open top end, the slug cavity having an inner sidewall and a slug seat at a bottom of the sidewall;

a propellant cavity configured for receiving a propellant; and at least one projection protruding radially inward from an inner sidewall of the slug cavity and extending circumferentially around at least a portion of the slug cavity below the open top end; and a slug received in at least a portion of the slug cavity of the slug casing, the slug comprising:

a cylindrical body portion;

a conical tip monolithically formed with the cylindrical body portion, at least one of the cylindrical body portion and the conical tip defining a hollow internal cavity;

at least one band recessed radially inward from an outer sidewall of the cylindrical body portion of the slug, the at least one band extending circumferentially around at least a portion of the outer sidewall of the cylindrical body portion; and at least one groove protruding radially inward into the at least one band wherein an external diameter of the cylindrical body portion of the slug is larger than an internal diameter of the slug cavity such that the slug is retained within the slug cavity by an interference fit, and wherein the at least one projection is configured for being received within at least a portion of the at least one groove.

* * * * *